US007344265B1

(12) United States Patent
Tieken

(10) Patent No.: US 7,344,265 B1
(45) Date of Patent: Mar. 18, 2008

(54) ILLUMINATED DWELLING TRIM APPARATUS

(76) Inventor: Mark A. Tieken, 1145 S. Odell St., Brownsburg, IN (US) 46112

( * ) Notice: Subject to any disclaimer, the term of this patent is extended or adjusted under 35 U.S.C. 154(b) by 257 days.

(21) Appl. No.: 11/337,058

(22) Filed: Jan. 23, 2006

(51) Int. Cl.
*F21S 8/00* (2006.01)
*F21V 21/00* (2006.01)

(52) U.S. Cl. ..... 362/145; 362/249; 362/240

(58) Field of Classification Search ..... 362/145, 362/147, 152, 237, 240, 244, 246, 249, 251, 362/362, 368, 806
See application file for complete search history.

(56) References Cited

U.S. PATENT DOCUMENTS

D347,682 S 6/1994 Kennedy et al.
5,669,709 A 9/1997 Adams
6,309,086 B1 * 10/2001 Tomlinson ..... 362/249
6,363,662 B1 * 4/2002 Coates ..... 362/147
6,572,239 B1 * 6/2003 Harbin ..... 362/145
6,652,112 B1 * 11/2003 Lucarelli ..... 362/145
7,066,618 B1 * 6/2006 Little ..... 362/147
2003/0142044 A1 7/2003 Barry
2003/0198054 A1 10/2003 Adams

* cited by examiner

*Primary Examiner*—Bao Q. Truong

(57) ABSTRACT

An illuminated dwelling trim apparatus includes an elongated housing that has a top wall, a bottom wall, a front wall, a back wall, a first end and a second end. The front wall has a plurality of openings extending therethrough. The openings are aligned between the first and second ends. A plurality of light emitters is mounted within the housing on the back wall. Each of the light emitters is electrically coupled together. The light emitters are aligned with and directed toward one of the openings. A power supply is electrically coupled to the plurality of light emitters. A trim element is attached to a house adjacent to and extends along a roofline of a house. The housing is attached to and extends along a length of the trim element.

8 Claims, 4 Drawing Sheets

ILLUMINATED DWELLING TRIM APPARATUS

BACKGROUND OF THE INVENTION

1. Field of the Invention

The present invention relates to lighted trim devices and more particularly pertains to a new lighted trim device for attaching to a roofline to serve as a gutter or bargeboard and which can be selectively illuminated when desired.

2. Description of the Prior Art

The use of lighted trim devices is known in the prior art. While these devices fulfill their respective, particular objectives and requirements, the need remains for a device that may be used as a trim element positioned adjacent to a roofline and which can be selectively illuminated when needed. The device is preferably includes covered light emitters to protect the light emitters from the elements or from objects striking the lights emitters. This will allow the light emitter to remain on the house throughout the year.

SUMMARY OF THE INVENTION

The present invention meets the needs presented above by generally comprising an elongated housing that has a top wall, a bottom wall, a front wall, a back wall, a first end and a second end. The front wall has a plurality of openings extending therethrough. The openings are aligned between the first and second ends. A plurality of light emitters is mounted within the housing on the back wall. Each of the light emitters is electrically coupled together. The light emitters are aligned with and directed toward one of the openings. A power supply is electrically coupled to the plurality of light emitters. A trim element is attached to a house adjacent to and extends along a roofline of a house. The housing is attached to and extends along a length of the trim element.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
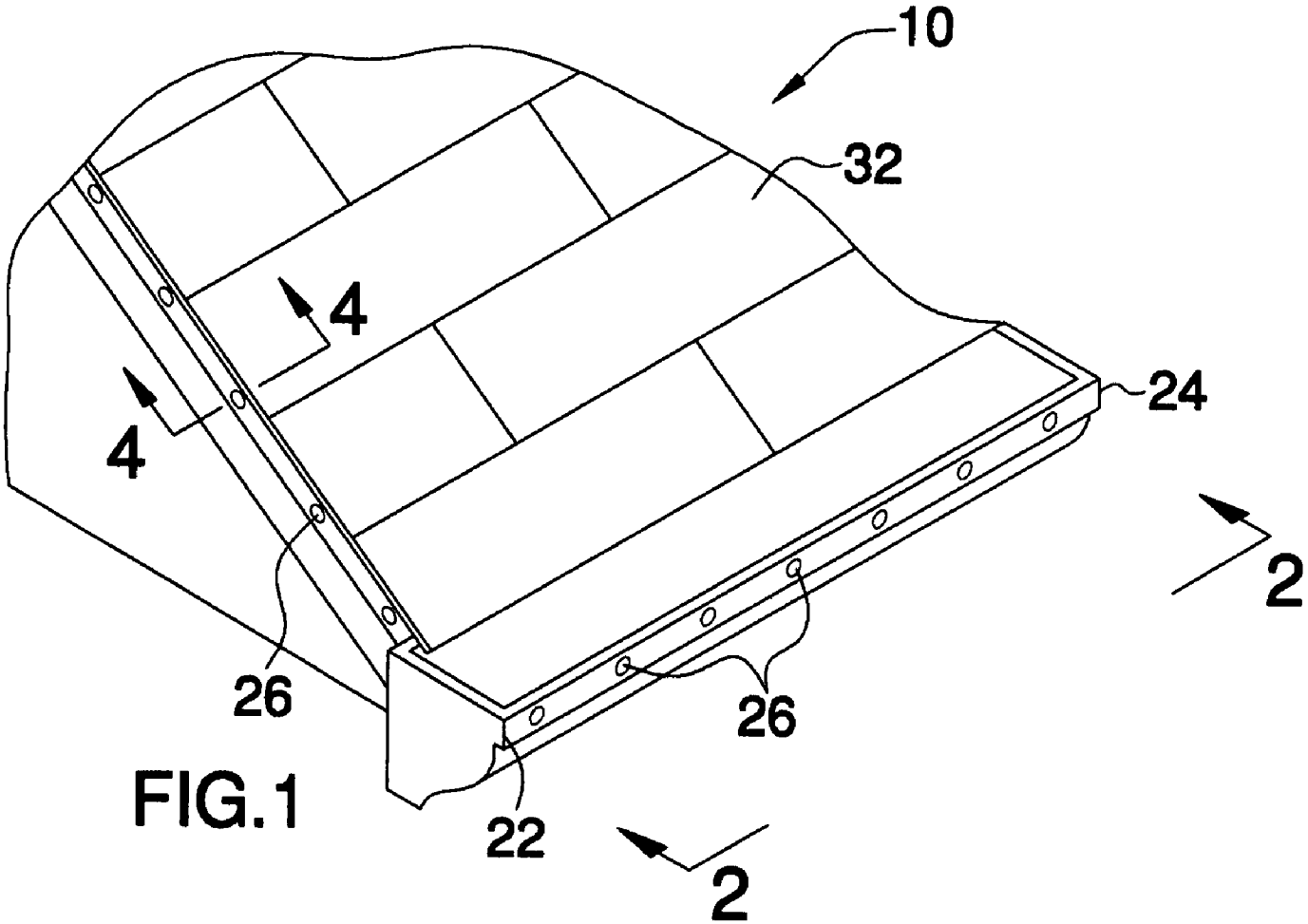
FIG. 1 is a perspective view of a illuminated dwelling trim apparatus according to the present invention.
Figure 2:
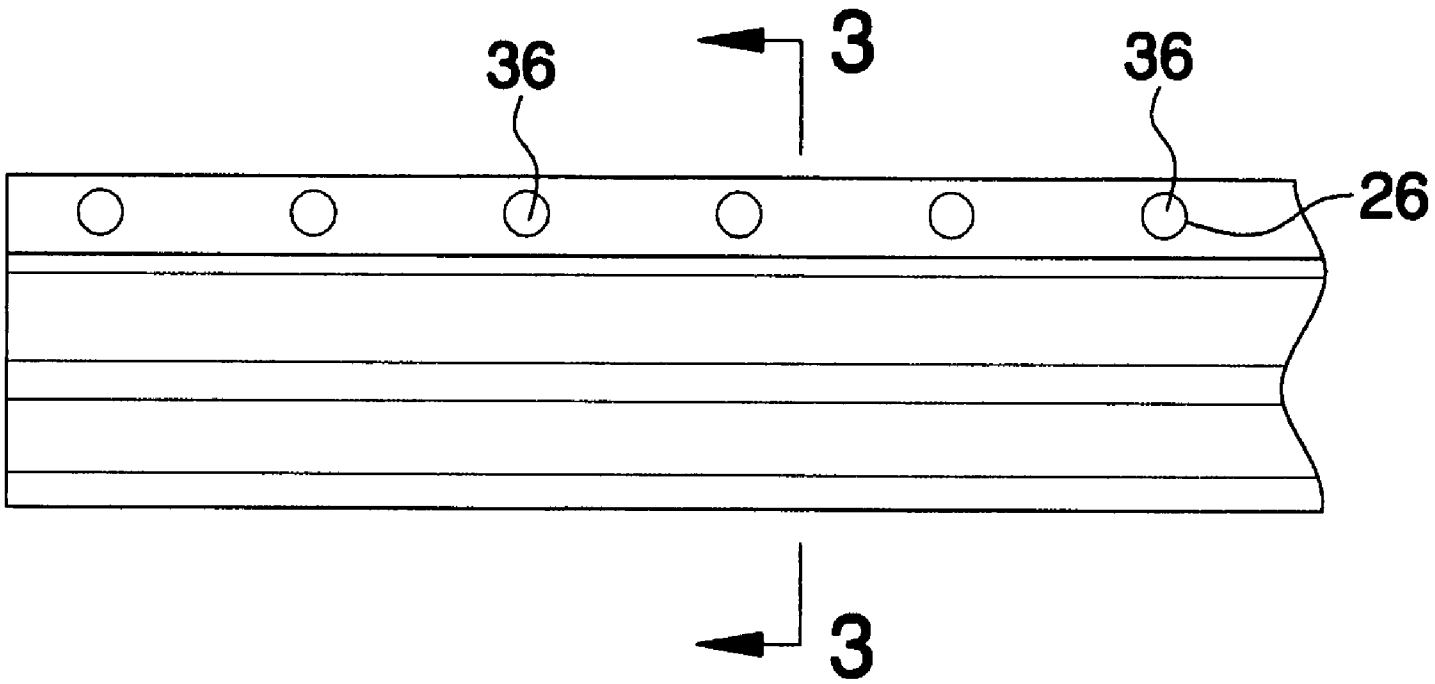
FIG. 2 is a front view of the present invention taken along line 2-2 of FIG. 1.
Figure 3:
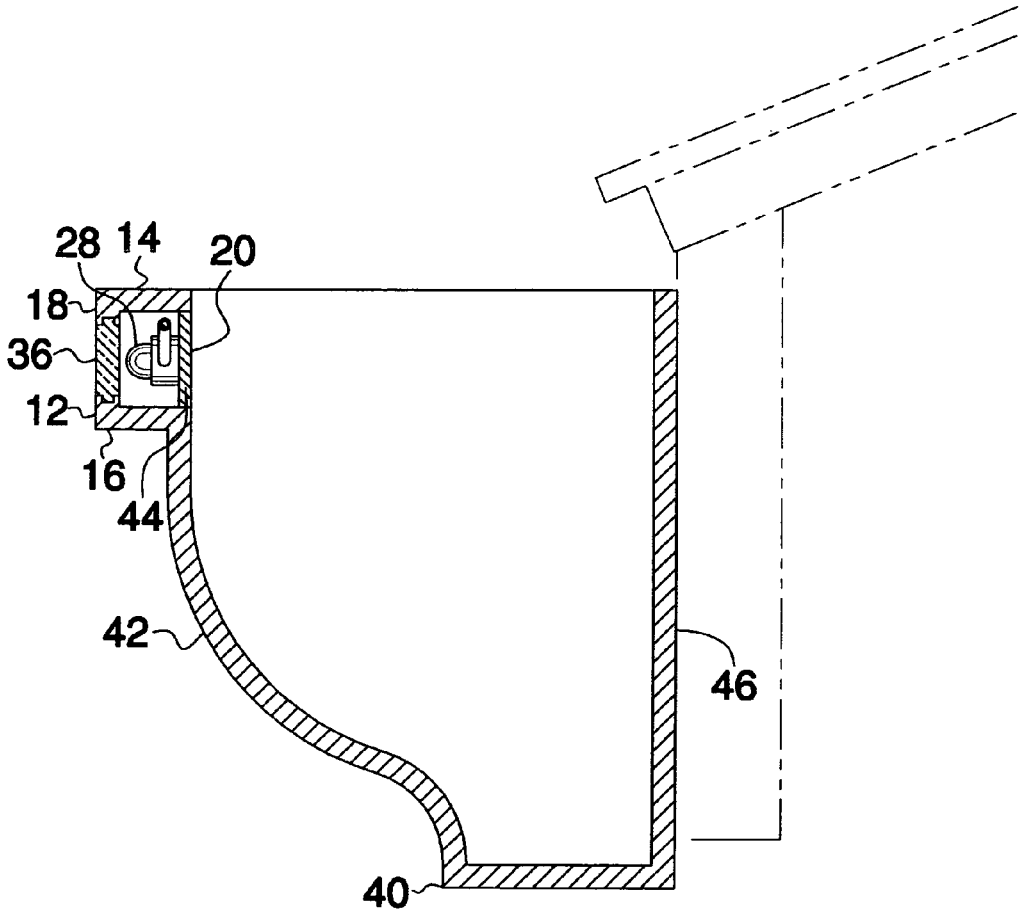
FIG. 3 is a cross-sectional view taken along line 3-3 of FIG. 2 of the present invention.
Figure 4:
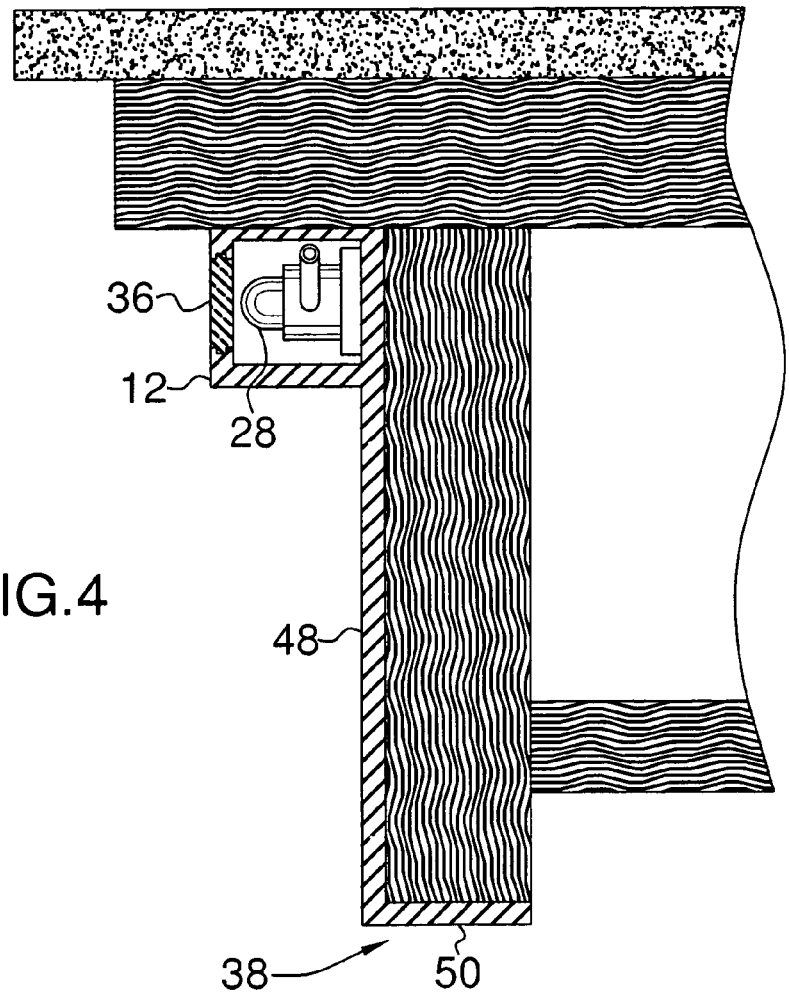
FIG. 4 is a cross-sectional view taken along line 4-4 of FIG. 1 of the present invention.
Figure 5:
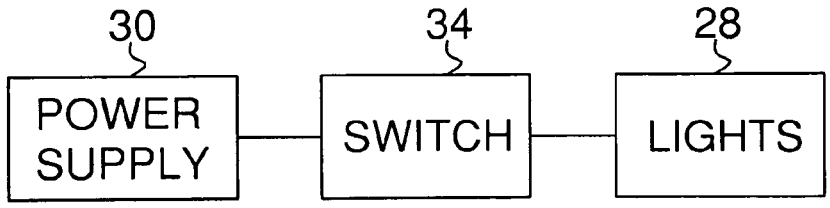
FIG. 5 is an electronic schematic view of the present invention.

With reference now to the drawings, and in particular to FIGS. 1 through 5 thereof, a new lighted trim device embodying the principles and concepts of the present invention and generally designated by the reference numeral 10 will be described.

As best illustrated in FIGS. 1 through 5, the illuminated dwelling trim apparatus 10 generally comprises an elongated housing 12 that has a top wall 14, a bottom wall 16, a front wall 18, a back wall 20, a first end 22 and a second end 24. The front wall 18 has a plurality of openings 26 extending therethrough. The openings 26 are aligned between the first 22 and second 24 ends. The back wall 20 is selectively removable from the housing 12.

A plurality of light emitters 28 is mounted within the housing 12 on the back wall 20. Each of the light emitters 28 is electrically coupled together. The light emitters 28 are each aligned with and directed toward one of the openings 26. A power supply 30 is electrically coupled to the plurality of light emitters 28. The power supply 30 is preferably the power supply of a house 32 on which the apparatus 10 is mounted and may be turned on or off with a conventional light switch 34.

A plurality of lenses 36 is provided. Each of the lenses 36 is positioned in one of the openings 26. Each of the lenses 36 is translucent and may be colored a color. The lenses 36 may also be colored different colors than adjacent ones of the lenses 36.

A trim element 38 is attached to the house 32 adjacent to and extending along a roofline of the house 32. The housing 12 is attached to and extends along a length of the trim element 38. In one embodiment, shown in FIGS. 1, 2 and 3, the trim element 38 comprises a gutter 40 attached to and extending along the housing 12. The housing 12 is positioned along a front side 42 of the gutter 40 and is positioned adjacent to an upper edge 44 of the gutter 40. The gutter 40 is attached to a house 32 with conventional fasteners adjacent to a bottom edge of a roofline of the house 32, wherein a rear side 46 of the gutter 40 is abutting the house 32. In a second embodiment, shown in FIGS. 1 and 4, the trim element 38 is a panel 48 attached to and extending downwardly from the housing 32. The panel 48 is attached to the house 32 with conventional fasteners adjacent to the roofline and defines a bargeboard. A flange may be attached to a bottom edge of the panel 48. The two embodiments may be used together as is shown in FIG. 1.

In use, the trim element 38 is positioned on the house 12 where appropriate and the light emitters 28 wired into the power supply 30 of the house 32. When desired, the light emitters 28 are turned on to illuminate the outline of a roof of the house 32 for decorative purposes.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lighted housing trim apparatus comprising:

an elongated housing having a top wall, a bottom wall, a front wall, a back wall, a first end and a second end, said front wall having a plurality of openings extending therethrough, said openings being aligned between said first and second ends;

a plurality of light emitters being mounted within said housing on said back wall, each of said light emitters being electrically coupled together, each of said light emitters being aligned with and directed toward one of said openings;

a power supply being electrically coupled to said plurality of light emitters; and a trim element being attached to a house adjacent to and extending along a roofline of the house, said housing being attached to and extending along a length of said trim element.

2. The apparatus according to claim 1, wherein said back wall is selectively removable from said housing.

3. The apparatus according to claim 1, further including a plurality of lenses, each of said lenses being positioned in one of said openings, each of said lenses being translucent.

4. The apparatus according to claim 3, wherein each of said lenses is colored a color.

5. The apparatus according to claim 1, wherein said trim element includes a gutter being attached to and extending along said housing, said housing being positioned along a front side of said gutter, said gutter being attached to a house adjacent to a bottom edge of a roofline of said house, wherein a rear side of said gutter is abutting said house.

6. The apparatus according to claim 5, wherein said housing is positioned adjacent to an upper edge of said gutter.

7. The apparatus according to claim 1, wherein said trim element includes a panel attached to and extending downwardly from said housing, said panel being attached to said house adjacent to the roofline and defining a bargeboard.

8. A lighted housing trim apparatus comprising:

an elongated housing having a top wall, a bottom wall, a front wall, a back wall, a first end and a second end, said front wall having a plurality of openings extending therethrough, said openings being aligned between said first and second ends, said back wall being selectively removable from said housing;

a plurality of light emitters being mounted within said housing on said back wall, each of said light emitters being electrically coupled together, each of said light emitters being aligned with and directed toward one of said openings;

a power supply being electrically coupled to said plurality of light emitters;

a plurality of lenses, each of said lenses being positioned in one of said openings, each of said lenses being translucent, each of said lenses being colored a color;

a gutter being attached to and extending along said housing, said housing being positioned along a front side of said gutter, said housing being positioned adjacent to an upper edge of said gutter, said gutter being attached to a house adjacent to a bottom edge of a roofline of said house, wherein a rear side of said gutter is abutting said house.

* * * * *